US008468985B2

(12) United States Patent
Cho et al.

(10) Patent No.: US 8,468,985 B2
(45) Date of Patent: Jun. 25, 2013

(54) ELECTRO-HYDRAULIC VARIABLE VALVE LIFT APPARATUS

(75) Inventors: Hosung Cho, Hwaseong-si (KR); Jin Gyu Yang, Hwaseong-si (KR); Myung Rae Cho, Incheon (KR); Hong Wook Lee, Yongin (KR); Duk Jin Park, Hwaseong-si (KR); Seong Hyuk Kang, Hwaseong (KR); Taewon Park, Hwaseong-si (KR); Wootae Kim, Suwon (KR); Myungsik Choi, Seoul (KR); Jin Woo Yang, Hwaseong-si (KR); Eui Chul Choi, Seoul (KR); Sung Han Kang, Hwaseong-si (KR); Won Gyu Kim, Seoul (KR); Dae Sung Kim, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 486 days.

(21) Appl. No.: 12/847,789

(22) Filed: Jul. 30, 2010

(65) Prior Publication Data

US 2011/0132297 A1 Jun. 9, 2011

(30) Foreign Application Priority Data

Dec. 4, 2009 (KR) ..... 10-2009-0120125

(51) Int. Cl.
*F01L 9/02* (2006.01)

(52) U.S. Cl.
USPC ..... 123/90.12; 213/90.13; 213/90.44; 213/90.46; 213/90.48; 213/90.55; 74/569

(58) Field of Classification Search
USPC ..... 123/90.12, 90.13, 90.44, 90.45, 90.46, 123/90.48, 90.52, 90.55; 74/567, 569
See application file for complete search history.

(56) References Cited

U.S. PATENT DOCUMENTS 7,509,933 B2 * 3/2009 Dingle ..... 123/90.52

* cited by examiner

*Primary Examiner* — Ching Chang
(74) *Attorney, Agent, or Firm* — Morgan, Lewis & Bockius LLP

(57) ABSTRACT

An electro-hydraulic variable valve lift apparatus may include a housing, a master portion which is slidably disposed to the housing and contacts a cam, a first oil supply portion which supplies hydraulic pressure, a slave piston which is slidably disposed within the housing and defines an oil chamber with the master portion, a latching portion which is supplied the hydraulic pressure from the first oil supply portion and selectively connects the slave piston and the master portion, a second oil supply portion which selectively supplies hydraulic pressure to the oil chamber so as to control relative distances between the master portion and the slave piston when the slave piston is disengaged with the master portion, and a stepped portion formed to the housing between the master portion and the slave piston to elastically support the master portion.

20 Claims, 5 Drawing Sheets

ELECTRO-HYDRAULIC VARIABLE VALVE LIFT APPARATUS

CROSS-REFERENCE TO RELATED APPLICATION

The present application claims priority to Korean Patent Application No. 10-2009-0120125 filed in the Korean Intellectual Property Office on Dec. 4, 2009, the entire contents of which is incorporated herein for all purposes by this reference.

BACKGROUND OF THE INVENTION

1. Field of the Invention

The present invention relates to a valve lift apparatus. More particularly, the present invention relates to an electro-hydraulic variable valve lift apparatus that can control valve lift according to engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches, such as designing of a plurality of cam and a variable valve lift (VVL) that can change valve lift according to engine speed, have been undertaken.

An electro-hydraulic valve train (EHV) using hydraulic pressure has been widely researched.

The EHV can control closing timing of a valve by controlling releasing timing of hydraulic pressure as well as control valve lift by using hydraulic pressure. However, when oil temperature of the EHV is not within an oil operation temperature range, supplying or releasing of hydraulic pressure can be unstable.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an electro-hydraulic variable valve lift apparatus that may be operated regardless operated oil temperature.

In an aspect of the present invention, the electro-hydraulic variable valve lift apparatus may include a housing, a master portion which is slidably disposed to the housing and contacts a cam, a first oil supply portion which supplies hydraulic pressure, a slave piston which is slidably disposed within the housing and defines an oil chamber with the master portion, a latching portion which is supplied the hydraulic pressure from the first oil supply portion and selectively connects the slave piston and the master portion, a second oil supply portion which selectively supplies hydraulic pressure to the oil chamber so as to control relative distances between the master portion and the slave piston when the slave piston is disengaged with the master portion, and a stepped portion formed to the housing between the master portion and the slave piston to elastically support the master portion.

The apparatus may further include a lost motion spring which is disposed between the master portion and the slave piston and elastically supports the master piston on the stepped portion.

The master portion may include a master piston which is slidable in the housing and contacts the cam, and an upper seat which is slidable in the housing and connected with the master piston, wherein a master portion oil supply passage is formed therein to receive the hydraulic pressure from the first oil supply portion.

The latching portion may include a latching pin hole formed to the slave piston, a connecting hole formed to the master portion and connected to the first oil supply portion, and a latching pin which is disposed in the latching pin hole and selectively connected to the connecting hole.

The apparatus may further include a latching pin spring which is disposed in the latching pin hole to elastically support the latching pin toward the master portion, wherein the latching pin is selectively connected to the connecting hole by the latching pin spring or the hydraulic pressure of the first oil supply portion.

The latching portion may include a latching pin hole formed to the master portion, a connecting hole formed to the slave piston, and a latching pin which is disposed to the latching pin hole and selectively connected to the connecting hole by the latching pin spring or the hydraulic pressure of the first oil supply portion. The apparatus may further include a latching pin spring which is disposed in the latching pin hole to elastically support the latching pin toward the slave piston, wherein the latching pin is selectively connected to the connecting hole by the latching pin spring or the hydraulic pressure of the first oil supply portion.

The first oil supply portion may include a first oil control valve, and the first oil control valve is controlled for the latching portion to connect the slave piston and the master portion when oil temperature is not within a predetermined oil operation temperature range, wherein the second oil supply portion may include a second oil control valve, and the first oil control valve is controlled for the latching portion to release the slave piston and the master portion, and the second oil supply portion is controlled to selectively supply hydraulic pressure to the oil chamber when oil temperature is within the predetermined oil operation temperature range.

The first oil supply portion may be a gap formed between the slave piston and the master portion.

The apparatus may further include a bypass portion which is formed in the slave piston and fluid-connected with the oil chamber to reduce closing/opening impact of a valve, wherein the bypass portion may include a first bypass oil passage fluid-connected with the oil chamber, a bypass chamber fluid-connected to the first bypass oil passage, a check ball disposed in the bypass chamber between the first bypass oil passage and the bypass chamber, a check ball spring elastically supporting the check ball in the bypass chamber, and a second bypass oil passage diverged from the bypass chamber to the oil chamber, wherein the check ball selectively fluid-connects the first bypass oil passage and the second bypass oil passage, and wherein the stepped portion selectively blocks a distal end of the second bypass oil passage.

The apparatus may further include a lost motion spring which is disposed between the master portion and the slave piston and supported by the stepped portion, wherein the latching portion may include a connecting hole formed to the master portion, a latching pin hole formed to the slave piston, and a latching pin which is disposed to the latching pin hole and selectively connected to the connecting hole.

The apparatus may further include a latching pin spring which is disposed in the latching pin hole to elastically support the latching pin toward the master portion, wherein the latching pin is selectively connected to the connecting hole by the latching pin spring or the hydraulic pressure of the first oil supply portion.

The latching portion may include a connecting hole formed to the slave piston, a latching pin hole formed to the master portion, and a latching pin which is disposed to the latching pin hole and selectively connected to the connecting hole.

The apparatus may include a latching pin spring which is disposed in the latching pin hole to elastically support the latching pin toward the slave piston wherein the latching pin is selectively connected to the connecting hole by the latching pin spring.

The first oil supply portion may include a first oil control valve, and the first oil control valve is controlled for the latching portion to connect the slave piston and the master portion when oil temperature is not within a predetermined oil operation temperature range, wherein the second oil supply portion may include a second oil control valve, and the first oil control valve is controlled for the latching portion to release the slave piston and the master portion, and the second oil supply portion is controlled to selectively supply hydraulic pressure to the oil chamber when oil temperature is within the predetermined oil operation temperature range.

The first oil supply portion may be a gap formed between the slave piston and the master portion.

As described above, the electro-hydraulic variable valve lift apparatus according to the exemplary embodiments of the present invention may be operated although oil temperature is within ranges that supplying and releasing of hydraulic pressure is not smooth.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
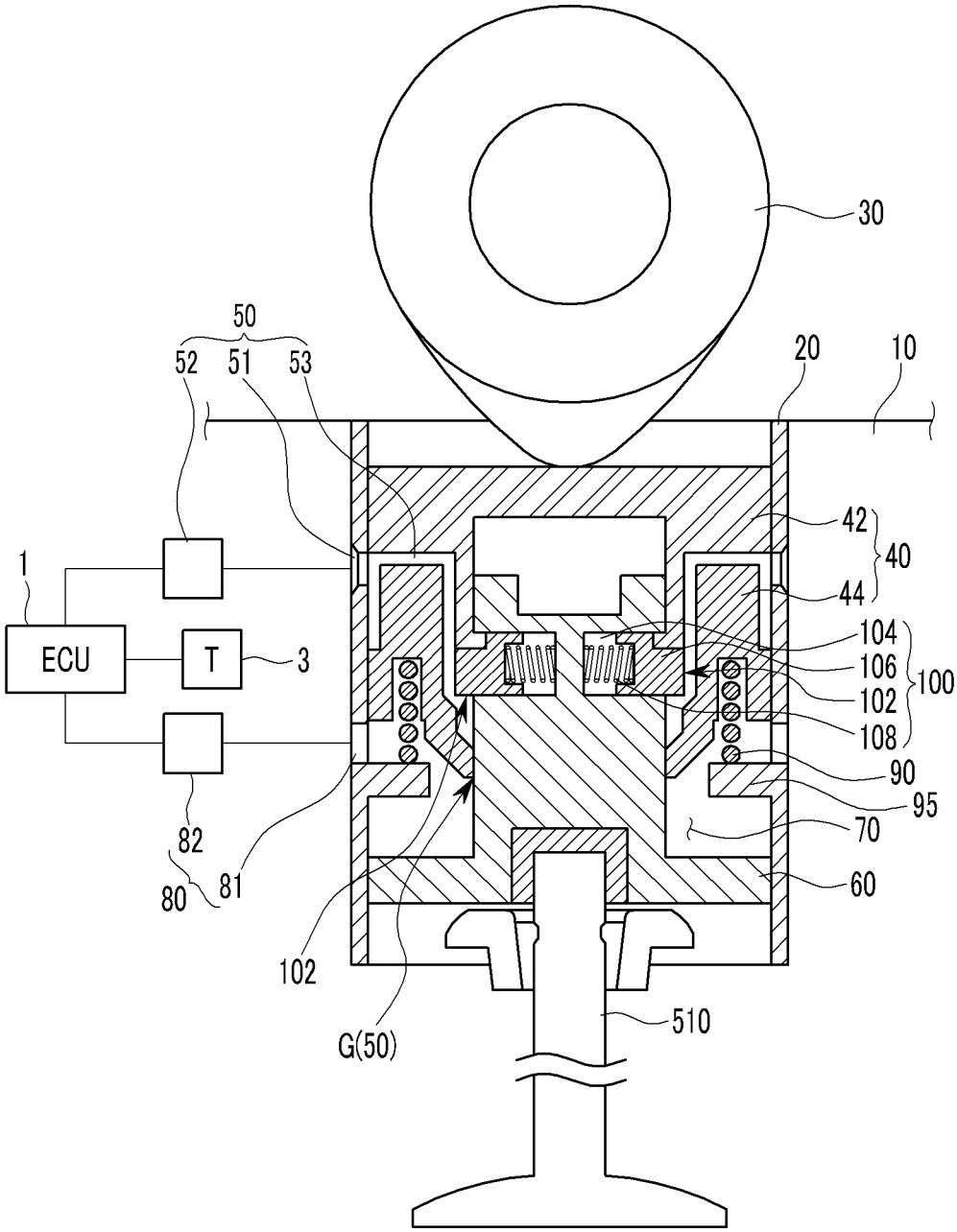
FIG. 1 is a cross-sectional view of an exemplary electro-hydraulic variable valve lift apparatus according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Figure 3:
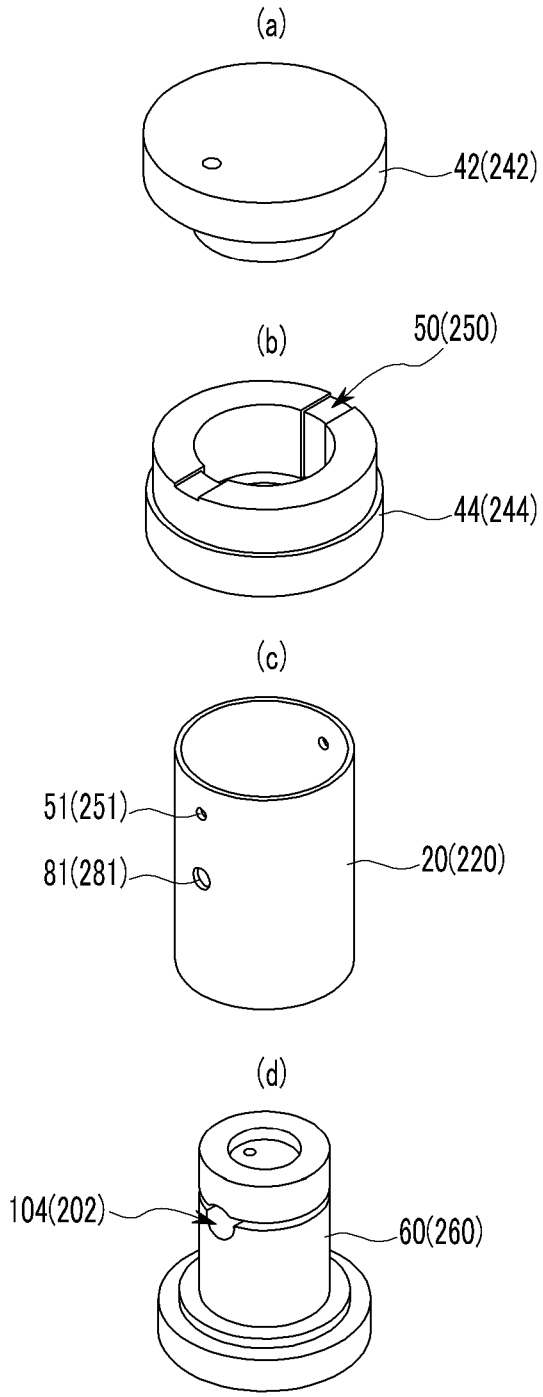
FIG. 3 is a perspective view of primary elements of the exemplary electro-hydraulic variable valve lift apparatus according to the present invention.

FIG. 1 is a cross-sectional view of an electro-hydraulic variable valve lift apparatus according to the first exemplary embodiment of the present invention and FIG. 3 is a perspective view of primary elements of the electro-hydraulic variable valve lift apparatus according to the first exemplary embodiment of the present invention.

Referring to FIG. 1 and FIG. 3, an electro-hydraulic variable valve lift apparatus according to the first exemplary embodiment of the present invention includes a housing 20 disposed to a cylinder head 10, a master portion 40 which is slidably disposed to the housing 20 and contacts a cam 30, a first oil supply portion 50 which selectively supplies hydraulic pressure to the master portion 40, a slave piston 60 which is slidably disposed within the housing 20 and defines an oil chamber 70 with the master portion 40, a latching portion 100 which is supplied hydraulic pressure from the first oil supply portion 50 and selectively connects the slave piston 60 and the master portion 40 and a second oil supply portion 80 which selectively supplies hydraulic pressure to the oil chamber 70 so as to control relative distances between the master portion 40 and the slave piston 60.

The housing 20 may be disposed to an engine 10, a cylinder head 10 or a cam carrier 10 and so on, or the housing 20 may be integrally formed to an engine 10, a cylinder head 10 or a cam carrier 10 and so on.

A lost motion spring 90 is disposed between the master portion 40 and the slave piston 60 and elastically supports the master portion 40 on a stepped portion 95.

The master portion 40 includes a master piston 42 which contacts the cam 30 and an upper seat 44 which is connected with the master piston 42 and of which a master portion oil supply passage 53 is formed thereto.

The latching portion 100 includes a connecting hole 102 formed to the master portion 40, a latching pin hole 104 formed to the slave piston 60 and a latching pin 106 which is disposed to the latching pin hole 104 and selectively connected to the connecting hole 102.

A latching pin spring 108 is disposed to the latching pin hole 104 to elastically support the latching pin 106.

Although it is not described in drawings, the latching pin spring 108 may be eliminated by forming an additional oil passage diverged from the master portion oil supply passage 53.

The first oil supply portion 50 includes a first oil control valve 52, and the first oil control valve 52 may be controlled for the latching portion 100 to connect the slave piston 60 and the master portion 40 when oil temperature is not within a predetermined oil operation temperature range.

The second oil supply portion 80 includes a second oil control valve 82, and the first oil control valve 52 may be controlled for the latching portion 100 to release the slave piston 60 and the master portion 40, and the second oil supply portion 80 may be controlled to selectively supply hydraulic pressure to the oil chamber 70 when oil temperature is within the predetermined oil operation temperature range.

In the housing 20, a first oil hole 51 and a second oil hole 81 are formed and respectively connected to the first oil control valve 52 and the second oil control valve 82.

An oil temperature sensor 3 detects present operated oil temperature. And when the oil temperature is not within normal oil operated temperature range, an ECU (engine control unit, 1) controls the first oil control valve 53 for the latching pin 106 to be connected to the connecting hole 102.

The normal oil operated temperature may be defined as a temperature that supplying and releasing of oil for controlling valve lift may smoothly be executed, for example, the temperature may be within −40° C. to 150° C. If the oil temperature is out of the normal oil operated temperature, the ECU 1 may malfunction, and thus the latching pin 106 is connected to the connecting hole 102. For example hydraulic pressure is released from the latching pin 106 to connect the master portion 40 and the slave piston 60. And then, the master portion 40 and the slave piston 60 integrally reciprocate and a valve 510 is opened and closed forming constant valve lift.

If the present oil temperature is within the normal oil operated temperature, the first oil supply portion 50 is controlled for the latching portion 100 to disconnect the slave piston 60 and the master portion 40 and the second oil supply portion 80 is controlled to selectively supply hydraulic pressure to the oil chamber 70. That is, relative distance between the master portion 40 and the slave piston 60 is controlled to adjust valve lift.

Controlling of the first oil supply portion 50 is executed according to temperature ranges and also controlling of the first oil supply portion 50 may be executed when constant valve lift is required so as to reduce frequent controlling of the valve lift.

Supplying oil to vary the valve lift and operations of the ECU 1 may be realized to a skilled person in the art referring to the detailed description of the present invention, so that detailed explanation will be omitted.

Figure 2:
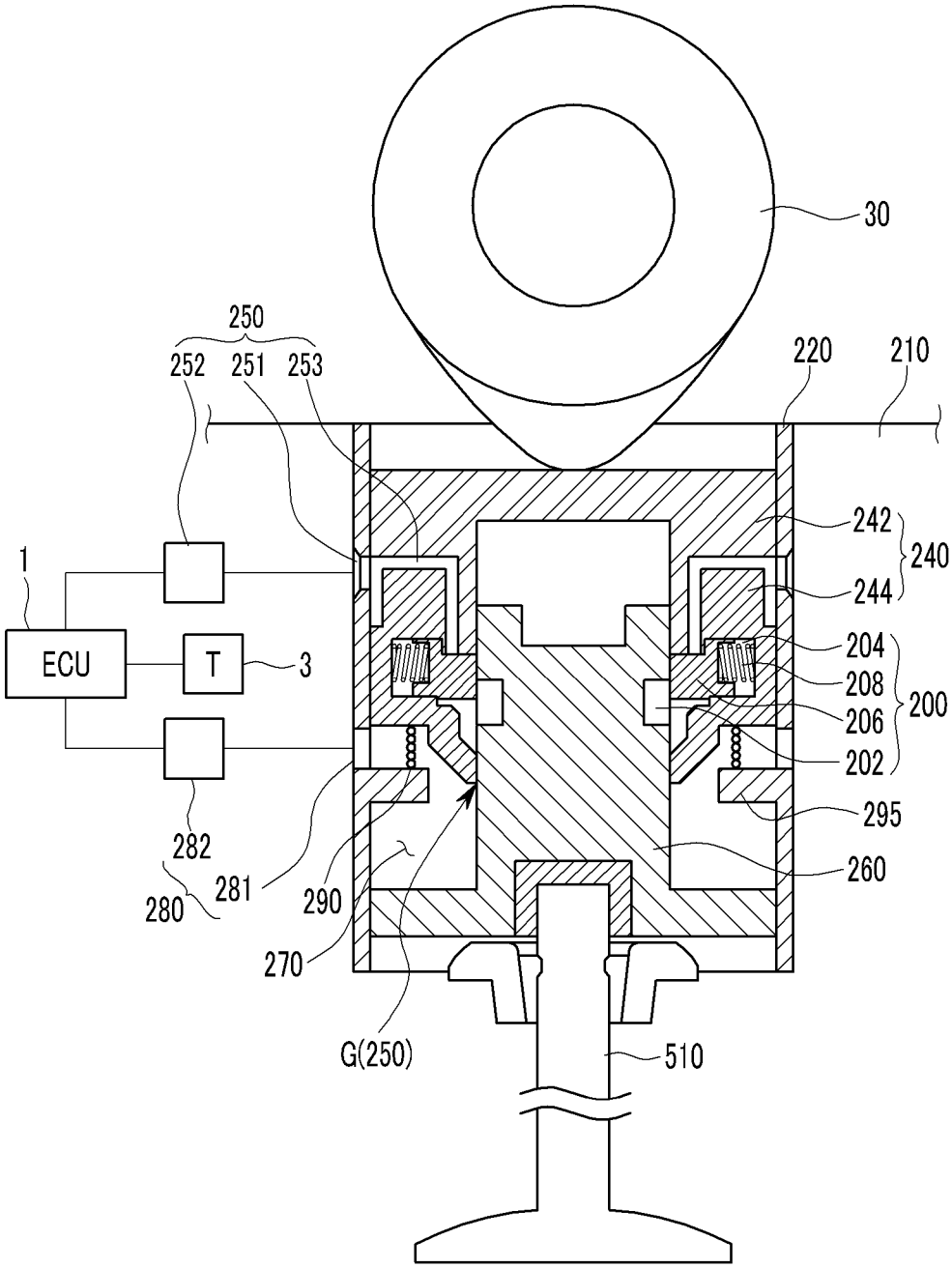
FIG. 2 is an exemplary variation of an exemplary electro-hydraulic variable valve lift apparatus according to the present invention.

FIG. 2 is an exemplary variation of an electro-hydraulic variable valve lift apparatus according to the first exemplary embodiment of the present invention.

Comparing an electro-hydraulic variable valve lift apparatus of an exemplary variation and the first exemplary embodiment of the present invention, scheme of a latching portion is modified.

That is, an electro-hydraulic variable valve lift apparatus according to the second exemplary embodiment of the present invention includes a housing 220 disposed to a cylinder head 210, a master portion 240 which is slidably disposed to the housing 220 and contacts a cam 30, a first oil supply portion 250 which selectively supplies hydraulic pressure to the master portion 240, a slave piston 260 which is slidably disposed within the housing 220 and defines an oil chamber 270 with the master portion 240, a latching portion 200 which is supplied hydraulic pressure from the first oil supply portion 250 and selectively connects the slave piston 260 and the master portion 240 and a second oil supply portion 280 which selectively supplies hydraulic pressure to the oil chamber 270 so as to control relative distances between the master portion 240 and the slave piston 260.

A lost motion spring 290 is disposed between the master portion 240 and the slave piston 260 and elastically supports the master portion 240 on a stepped portion 295.

The master portion 240 includes a master piston 242 which contacts the cam 30 and an upper seat 244 which is connected with the master piston 242 and of which a master portion oil supply passage 253 is formed thereto.

The first oil supply portion 250 includes a first oil control valve 252, and the first oil control valve 252 may be controlled for the latching portion 200 to connect the slave piston 260 and the master portion 240 when oil temperature is not within a predetermined oil operation temperature range.

The second oil supply portion 280 includes a second oil control valve 282, and the first oil control valve 252 may be controlled for the latching portion 200 to release the slave piston 260 and the master portion 240, and the second oil supply portion 280 may be controlled to selectively supply hydraulic pressure to the oil chamber 270 when oil temperature is within the predetermined oil operation temperature range.

In the housing 220, a first oil hole 251 and a second oil hole 281 are formed and respectively connected to the first oil control valve 252 and the second oil control valve 282.

The latching portion 200 includes a latching pin hole 204 formed to the master portion 240, a connecting hole 202 formed to the slave piston 260 and a latching pin 206 which is disposed to the latching pin hole 204 and selectively connected to the connecting hole 202.

A latching pin spring 208 is disposed to the latching pin hole 204 to elastically support the latching pin 206.

Hereinafter, referring to FIG. 1 to FIG. 3, operations of the electro-hydraulic variable valve lift apparatus according to the first exemplary embodiment of the present invention will be described. When present oil temperature is not within the predetermined oil operation temperature range, or when frequent controlling of the valve lift is not required, the first oil control valve 52 and 252 is controlled for the latching pin 106 and 206 to connect the slave piston 60 and 260 and the master portion 40 and 240.

In this case, the second oil control valve 82 and 282 is not operated, and constant valve lift may be realized by the cam 30.

When the present oil temperature is within the normal oil operated temperature, or when frequent controlling of the valve lift is required, the first oil control valve 52 and 252 is controlled for the latching pin 106 and 206 to be separated from the connecting hole 102 and 202, and the second oil control valve 82 and 282 is controlled to adjust oil supply amount supplied to the oil chamber 70 and 270.

According to oil supplied amount to the oil chamber 70 and 270, relative distance between the master portion 40 and 240 and the slave piston 60 and 260 is varied and then valve lift of the valve 510 is changed.

Figure 4:
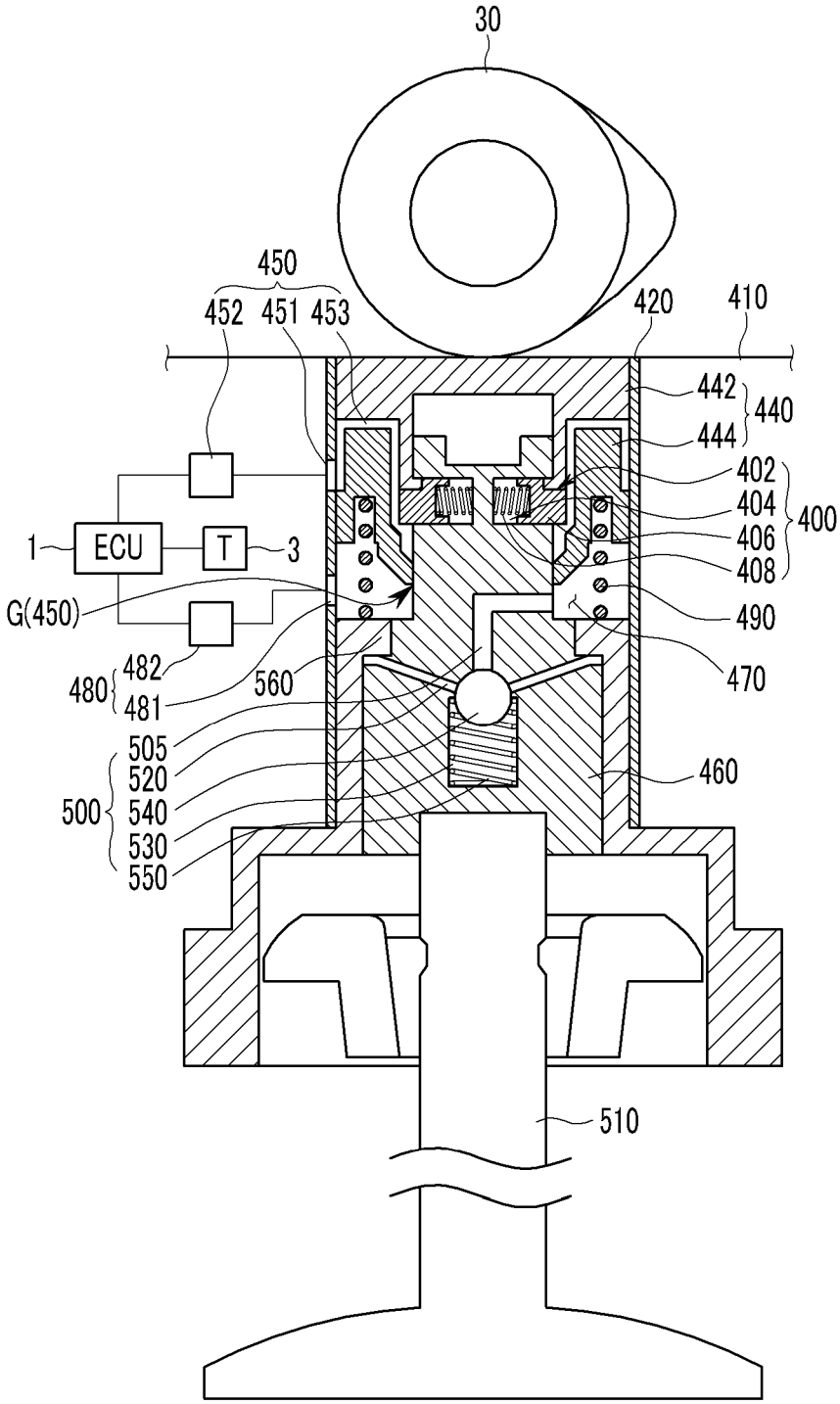
FIG. 4 is a cross-sectional view of an exemplary electro-hydraulic variable valve lift apparatus according to the present invention.

FIG. 4 is a cross-sectional view of an electro-hydraulic variable valve lift apparatus according to the second exemplary embodiment of the present invention.

Referring to FIG. 4, an electro-hydraulic variable valve lift apparatus according to the second exemplary embodiment of the present invention a housing 420 disposed to a cylinder head 410, a master portion 440 which is slidably disposed to the housing 420 and contacts a cam 30, a first oil supply portion 450 which selectively supplies hydraulic pressure to the master portion 440, a slave piston 460 which is slidably disposed within the housing 420 and defines an oil chamber 470 with the master portion 440, a latching portion 400 which is supplied hydraulic pressure from the first oil supply portion 450 and selectively connects the slave piston 460 and the master portion 440 and a second oil supply portion 480 which selectively supplies hydraulic pressure to the oil chamber 470 so as to control relative distances between the master portion 440 and the slave piston 460.

A lost motion spring 490 is disposed between the master portion 440 and the slave piston 460 and elastically supports the master portion 440.

The master portion 440 includes a master piston 442 which contacts the cam 30 and an upper seat 444 which is connected with the master piston 442 and of which a master portion oil supply passage 453 is formed thereto.

The latching portion 400 includes a connecting hole 402 formed to the master portion 440, a latching pin hole 404 formed to the slave piston 460 and a latching pin 406 which is disposed to the latching pin hole 404 and selectively connected to the connecting hole 402.

A latching pin spring 408 is disposed to the latching pin hole 404 to elastically support the latching pin 406.

The first oil supply portion 450 includes a first oil control valve 452, and the first oil control valve 452 may be controlled for the latching portion 400 to connect the slave piston 460 and the master portion 440 when oil temperature is not within a predetermined oil operation temperature range.

The second oil supply portion 480 includes a second oil control valve 482, and the first oil control valve 452 may be controlled for the latching portion 400 to release the slave piston 460 and the master portion 440, and the second oil supply portion 480 may be controlled to selectively supply hydraulic pressure to the oil chamber 470 when oil temperature is within the predetermined oil operation temperature range.

In the housing 420, a first oil hole 451 and a second oil hole 481 are formed and respectively connected to the first oil control valve 452 and the second oil control valve 482.

In the second exemplary embodiment of the present invention, the electro-hydraulic variable valve lift apparatus further includes a bypass portion 500 formed to the slave piston 460 for reducing impact during closing/opening of the valve 510.

The bypass portion 500 includes a first bypass oil passage 505 connected with the oil chamber 470, a bypass chamber 530 connected to the first bypass oil passage 505, a check ball 540 disposed between the first bypass oil passage 505 and the bypass chamber 530, a check ball spring 550 elastically supporting the check ball 540 and a second bypass oil passage 520 diverged from the bypass chamber 530, wherein a stepped portion 560 is formed to the housing 420 and the second bypass oil passage 520 is formed in the slave piston 460. A distal end of the second bypass oil passage 520 may be aligned toward the stepped portion 560 while the slave piston 460 is engaged with the stepped portion 560.

Figure 5:
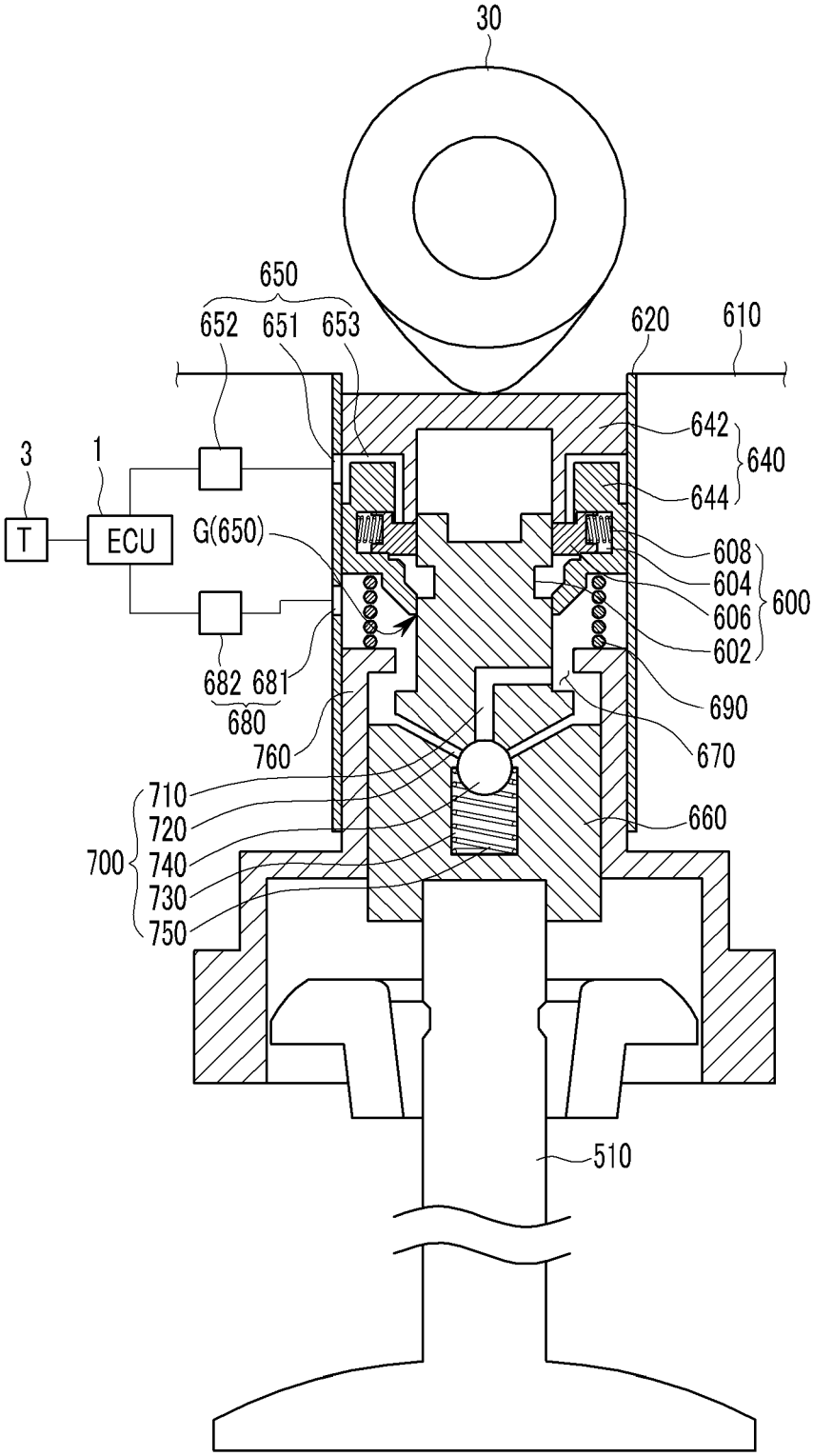
FIG. 5 is an exemplary variation of an exemplary electro-hydraulic variable valve lift apparatus according to the present invention.

FIG. 5 is an exemplary variation of an electro-hydraulic variable valve lift apparatus according to the second exemplary embodiment of the present invention.

Referring to FIG. 5, an exemplary variation of an electro-hydraulic variable valve lift apparatus according to the second exemplary embodiment of the present invention includes a housing 620 disposed to a cylinder head 610, a master portion 640 which is slidably disposed to the housing 620 and contacts a cam 30, a first oil supply portion 650 which selectively supplies hydraulic pressure to the master portion 640, a slave piston 660 which is slidably disposed within the housing 620 and defines an oil chamber 670 with the master portion 640, a latching portion 600 which is supplied hydraulic pressure from the first oil supply portion 650 and selectively connects the slave piston 660 and the master portion 640 and a second oil supply portion 680 which selectively supplies hydraulic pressure to the oil chamber 670 so as to control relative distances between the master portion 640 and the slave piston 660.

A lost motion spring 690 is disposed between the master portion 640 and the slave piston 660 and elastically supports the master portion 640.

The master portion 640 includes a master piston 642 which contacts the cam 30 and an upper seat 644 which is connected with the master piston 642 and of which a master portion oil supply passage 653 is formed thereto.

The latching portion 600 includes a latching pin hole 604 formed to the master portion 40, a connecting hole 602 formed to the slave piston 660 and a latching pin 606 which is disposed to the latching pin hole 604 and selectively connected to the connecting hole 602.

A latching pin spring 608 is disposed to the latching pin hole 604 to elastically support the latching pin 606.

The first oil supply portion 650 includes a first oil control valve 652, and the first oil control valve 652 may be controlled for the latching portion 600 to connect the slave piston 660 and the master portion 640 when oil temperature is not within a predetermined oil operation temperature range.

The second oil supply portion 680 includes a second oil control valve 682, and the first oil control valve 652 may be controlled for the latching portion 600 to release the slave piston 660 and the master portion 640, and the second oil supply portion 680 may be controlled to selectively supply hydraulic pressure to the oil chamber 670 when oil temperature is within the predetermined oil operation temperature range.

In the housing 620, a first oil hole 651 and a second oil hole 681 are formed and respectively connected to the first oil control valve 652 and the second oil control valve 682.

In the variation of the second exemplary embodiment of the present invention, the electro-hydraulic variable valve lift apparatus further includes a bypass portion 700 formed to the slave piston 660 for reducing impact during closing/opening of the valve 510.

The bypass portion 700 includes a first bypass oil passage 710 connected with the oil chamber 670, a bypass chamber 730 connected to the first bypass oil passage 710, a check ball 740 disposed between the first bypass oil passage 710 and the bypass chamber 730, a check ball spring 750 elastically supporting the check ball 740 and a second bypass oil passage 720 diverged from the bypass chamber 740 is disposed, wherein a stepped portion 760 is formed to the housing 620 and the second bypass oil passage 720 is formed in the slave piston 660. A distal end of the second bypass oil passage 720 may be aligned toward the stepped portion 760 while the slave piston 660 is engaged with the stepped portion 760.

The electro-hydraulic variable valve lift apparatus according to the second exemplary embodiment is similar to the electro-hydraulic variable valve lift apparatus according to the first exemplary embodiment of the present invention, so that only operations of the bypass portion 500 and 700 will be described and repeated explanation will be omitted.

In the second exemplary embodiment of the present invention, when the cam 30 pushes the master portion 440 and 640, the oil is supplied to the bypass chamber 530 and 730 and the second bypass oil passage 520 and 720 via the first bypass oil passage 505 and 710 and the check ball 540 and 740.

At this moment, opening of the valve 510 is retarded in some interval and thus impact of opening of the valve 510 can be reduced.

On the contrary to this, when the valve 510 is closed, closing of the valve 510 is retarded in some interval by the bypass portion 500 and 700 and thus impact of closing of the valve 510 can be reduced.

That is, the operations of the bypass portion 500 and 700 may induce reducing of closing/opening of the valve 510 so that vibration of an engine may be reduced.

In an exemplary variation of the present invention, the first oil control valve 25, 252, 452 and 652 may be omitted.

In this case, the first oil supply portion 50, 250, 450 and 650 may be an oil line, which is supplied hydraulic pressure from an oil pump (not shown) and the first oil supply portion 50, 250, 450 and 650 supplies oil to the master portion 40, 240, 440 and 640.

In this exemplary variation of the present invention, the first oil supply portion 52, 250, 450 and 650 may not supplies hydraulic pressure to the master portion 40, 240, 440 and 640 sufficiently when an engine starts, so that the electro-hydraulic variable valve lift apparatus realizes constant valve lift.

When the master portion 40, 240, 440 and 640 receives hydraulic pressure sufficiently due to the engine operation, the latching pin 106, 206, 406 and 606 is disengaged from the connecting hole 102, 202, 402 and 602, and then the valve lift is variable according to oil supplying from the second oil supply portion 80, 580, 480 and 680

Although oil temperature is low and oil viscosity is high, if the valve lift can be variable by the oil supplying, the first oil control valve 25, 252, 452 and 652 may be omitted.

In another exemplary variation of the present invention, the first oil supply portion 50, 250, 450 and 650 may be a gap G formed between the slave piston 60, 260, 460 and 660 and the master portion 40, 240, 440 and 640.

The first oil supply portion 50, 250, 450 and 650 may be replaced by the gap G. And also, when the engine starts, the gag G may not sufficiently supplies oil to the master portion 40, 240, 440 and 640, so that the electro-hydraulic variable valve lift apparatus realizes constant valve lift.

When the master portion 40, 240, 440 and 640 receives hydraulic pressure sufficiently due to the engine operation, the latching pin 106, 206, 406 and 606 is disengaged from the connecting hole 102, 202, 402 and 602, and then the valve lift is variable according to oil supplying from the second oil supply portion 80, 580, 480 and 680

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic variable valve lift apparatus comprising:

a housing;

a master portion which is slidably disposed to the housing and contacts a cam;

a first oil supply portion which supplies hydraulic pressure;

a slave piston which is slidably disposed within the housing and defines an oil chamber with the master portion;

a latching portion which is supplied the hydraulic pressure from the first oil supply portion and selectively connects the slave piston and the master portion;

a second oil supply portion which selectively supplies hydraulic pressure to the oil chamber so as to control relative distances between the master portion and the slave piston when the slave piston is disengaged with the master portion; and a stepped portion formed to the housing between the master portion and the slave piston to elastically support the master portion.

2. The apparatus of claim 1, wherein the apparatus further comprises a lost motion spring which is disposed between the master portion and the slave piston and elastically supports the master piston on the stepped portion.

3. The apparatus of claim 1, wherein the master portion comprises:

a master piston which is slidable in the housing and contacts the cam; and an upper seat which is slidable in the housing and connected with the master piston, wherein a master portion oil supply passage is formed therein to receive the hydraulic pressure from the first oil supply portion.

4. The apparatus of claim 1, wherein the latching portion comprises:

a latching pin hole formed to the slave piston;

a connecting hole formed to the master portion and fluid-connected to the first oil supply portion; and a latching pin which is disposed in the latching pin hole and selectively connected to the connecting hole.

5. The apparatus of claim 4, wherein the apparatus further comprises a latching pin spring which is disposed in the latching pin hole to elastically support the latching pin toward the master portion, wherein the latching pin is selectively connected to the connecting hole by the latching pin spring or the hydraulic pressure of the first oil supply portion.

6. The apparatus of claim 1, wherein the latching portion comprises:

a latching pin hole formed to the master portion;

a connecting hole formed to the slave piston; and a latching pin which is disposed to the latching pin hole and selectively connected to the connecting hole by the latching pin spring or the hydraulic pressure of the first oil supply portion.

7. The apparatus of claim 6, wherein the apparatus further comprises a latching pin spring which is disposed in the latching pin hole to elastically support the latching pin toward the slave piston, wherein the latching pin is selectively connected to the connecting hole by the latching pin spring or the hydraulic pressure of the first oil supply portion.

8. The apparatus of claim 1, wherein the first oil supply portion comprises a first oil control valve, and the first oil control valve is controlled for the latching portion to connect the slave piston and the master portion when oil temperature is not within a predetermined oil operation temperature range.

9. The apparatus of claim 8, wherein the second oil supply portion comprises a second oil control valve, and the first oil control valve is controlled for the latching portion to release the slave piston and the master portion, and the second oil supply portion is controlled to selectively supply hydraulic pressure to the oil chamber when oil temperature is within the predetermined oil operation temperature range.

10. The apparatus of claim 1, the first oil supply portion is a gap formed between the slave piston and the master portion.

11. The apparatus of claim 1, the apparatus further comprises a bypass portion which is formed in the slave piston and fluid-connected with the oil chamber to reduce closing/opening impact of a valve.

12. The apparatus of claim 11, wherein the bypass portion comprises:

a first bypass oil passage fluid-connected with the oil chamber;

a bypass chamber fluid-connected to the first bypass oil passage;

a check ball disposed in the bypass chamber between the first bypass oil passage and the bypass chamber;

a check ball spring elastically supporting the check ball in the bypass chamber; and a second bypass oil passage diverged from the bypass chamber to the oil chamber, wherein the check ball selectively fluid-connects the first bypass oil passage and the second bypass oil passage, and wherein the stepped portion selectively blocks a distal end of the second bypass oil passage.

13. The apparatus of claim 12, wherein the apparatus further comprises a lost motion spring which is disposed between the master portion and the slave piston and supported by the stepped portion.

14. The apparatus of claim 12, wherein the latching portion comprises:

a connecting hole formed to the master portion;

a latching pin hole formed to the slave piston; and a latching pin which is disposed to the latching pin hole and selectively connected to the connecting hole.

15. The apparatus of claim 14, further comprising a latching pin spring which is disposed in the latching pin hole to elastically support the latching pin toward the master portion, wherein the latching pin is selectively connected to the connecting hole by the latching pin spring or the hydraulic pressure of the first oil supply portion.

16. The apparatus of claim 12, wherein the latching portion comprises:

a connecting hole formed to the slave piston;

a latching pin hole formed to the master portion; and a latching pin which is disposed to the latching pin hole and selectively connected to the connecting hole.

17. The apparatus of claim 16, further comprising a latching pin spring which is disposed in the latching pin hole to elastically support the latching pin toward the slave piston wherein the latching pin is selectively connected to the connecting hole by the latching pin spring.

18. The apparatus of claim 12, wherein the first oil supply portion comprises a first oil control valve, and the first oil control valve is controlled for the latching portion to connect the slave piston and the master portion when oil temperature is not within a predetermined oil operation temperature range.

19. The apparatus of claim 18, wherein the second oil supply portion comprises a second oil control valve, and the first oil control valve is controlled for the latching portion to release the slave piston and the master portion, and the second oil supply portion is controlled to selectively supply hydraulic pressure to the oil chamber when oil temperature is within the predetermined oil operation temperature range.

20. The apparatus of claim 11, the first oil supply portion is a gap formed between the slave piston and the master portion.

* * * * *